US009418607B2

(12) United States Patent
Hsu et al.

(10) Patent No.: US 9,418,607 B2
(45) Date of Patent: Aug. 16, 2016

(54) UTILIZING GRAY CODE TO REDUCE POWER CONSUMPTION IN DISPLAY SYSTEM

(71) Applicant: Parade Technologies, Ltd., George Town, Grand Cayman (KY)

(72) Inventors: Ta-Tao Hsu, Taipei (TW); Quan Yu, Shanghai (CN); Yueh-Lin Yang, Taipei (TW)

(73) Assignee: Parade Technologies, Ltd., George Town (KY)

( * ) Notice: Subject to any disclaimer, the term of this patent is extended or adjusted under 35 U.S.C. 154(b) by 112 days.

(21) Appl. No.: 13/961,035

(22) Filed: Aug. 7, 2013

(65) Prior Publication Data

US 2015/0042551 A1 Feb. 12, 2015

(51) Int. Cl.
*G09G 3/36* (2006.01)
*G09G 3/20* (2006.01)

(52) U.S. Cl.
CPC ..... *G09G 3/3611* (2013.01); *G09G 3/2092* (2013.01); *G09G 2310/0213* (2013.01); *G09G 2330/021* (2013.01)

(58) Field of Classification Search
CPC ..... G06F 2205/102; G09G 3/2092; G09G 3/3611; G09G 2310/0213; G09G 2330/021
USPC ..... 345/98, 100
See application file for complete search history.

(56) References Cited

U.S. PATENT DOCUMENTS

| | | | | |
|---|---|---|---|---|
| 2003/0169195 | A1 | 9/2003 | Hietala et al. | |
| 2007/0229338 | A1 | 10/2007 | Tsao et al. | |
| 2008/0224904 | A1 | 9/2008 | Fujimura et al. | |
| 2009/0278865 | A1 * | 11/2009 | Kang et al. | 345/690 |
| 2010/0079362 | A1 | 4/2010 | Bu et al. | |
| 2012/0293444 | A1 * | 11/2012 | Wong et al. | 345/174 |

FOREIGN PATENT DOCUMENTS

| | | | |
|---|---|---|---|
| TW | 200842893 | A | 11/2008 |
| TW | I386903 | B | 2/2013 |
| TW | I396171 | B | 5/2013 |

OTHER PUBLICATIONS

PCT International Search Report, PCT Application No. PCT/US14/46767, Oct. 27, 2014, 16 pages.
Taiwan Office Action, Taiwan Application No. 103127135, May 12, 2016, 6 pages. (with concise explanation of relevance).

* cited by examiner

*Primary Examiner* — Gustavo Polo
(74) *Attorney, Agent, or Firm* — Fenwick & West LLP

(57) ABSTRACT

A system and method are disclosed to utilize Gray code in order to reduce the power consumption of column drivers in a display system. Binary source data is received from a timing controller. A Gray code digitizer converts and encodes the binary source data into a binary portion of data and a Gray code data. The binary portion data and the Gray code data are transmitted through a shift register to a digital-to-analog converter. The shift register consumes less power processing the converted binary portion of data and Gray code data than the corresponding binary source data. The digital-to-analog converter decodes the Gray code and generates corresponding gamma voltage levels for display use.

16 Claims, 5 Drawing Sheets

UTILIZING GRAY CODE TO REDUCE POWER CONSUMPTION IN DISPLAY SYSTEM

BACKGROUND

1. Field of Art

The disclosure generally relates to a display device utilizing column drivers to drive a display. More specifically, the disclosure relates to reducing power consumption of column drivers.

2. Description of the Related Art

In certain systems, the display subsystem consumes a significant portion of overall system power. The power consumed by the display subsystem includes both the backlight and panel electronics. A typical pixel based display includes numerous column drivers (CD) that drive a group of pixels, often a row or a column. Through multiplexing, the column drivers are able to drive any individual pixel through a unique combination of voltage source and sink. A timing controller (TCON) is used to control the column drivers and display a desired image. Generally, the TCON passes binary data to a column driver and a column driver processes the binary data using various components of the column driver to appropriately drive the display panel. Certain series of binary data received from the TCON may cause high power consumption in a column driver. For example, if the binary data is first the binary code for 3, 011, and subsequently transitions to the binary code for 4, 100, all bits of the binary data change. The power consumed by column drivers may be a significant portion of power consumed by a display subsystem.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Configuration Overview

Various embodiments are disclosed for a system and a method to utilize Gray code in order to reduce the power consumption of column drivers in a display system. In one embodiment, binary source data is received from a timing controller. A Gray code digitizer converts and encodes the binary source data into a binary portion of data and Gray code data. The binary portion data and the Gray code data are transmitted through a shift register and level shifter to a digital-to-analog converter (DAC). On average, the shift register consumes less power processing the converted binary portion of data and Gray code data than the corresponding binary source data. The reduction in power consumption is accomplished by reducing the average number of bits that transition from 1 to 0 or 0 to 1. The digital-to-analog converter decodes the Gray code and generates corresponding gamma voltage levels for display use. Although generally described for use in conjunction with liquid crystal display (LCD) or LCD-based displays, the described method may also be applicable to any pixel-based display or a display with a similar configuration such as plasma or plasma-based displays, light-emitting diode (LED), or organic light-emitting diode (OLED) displays.

Operating Environment

Figure 1:
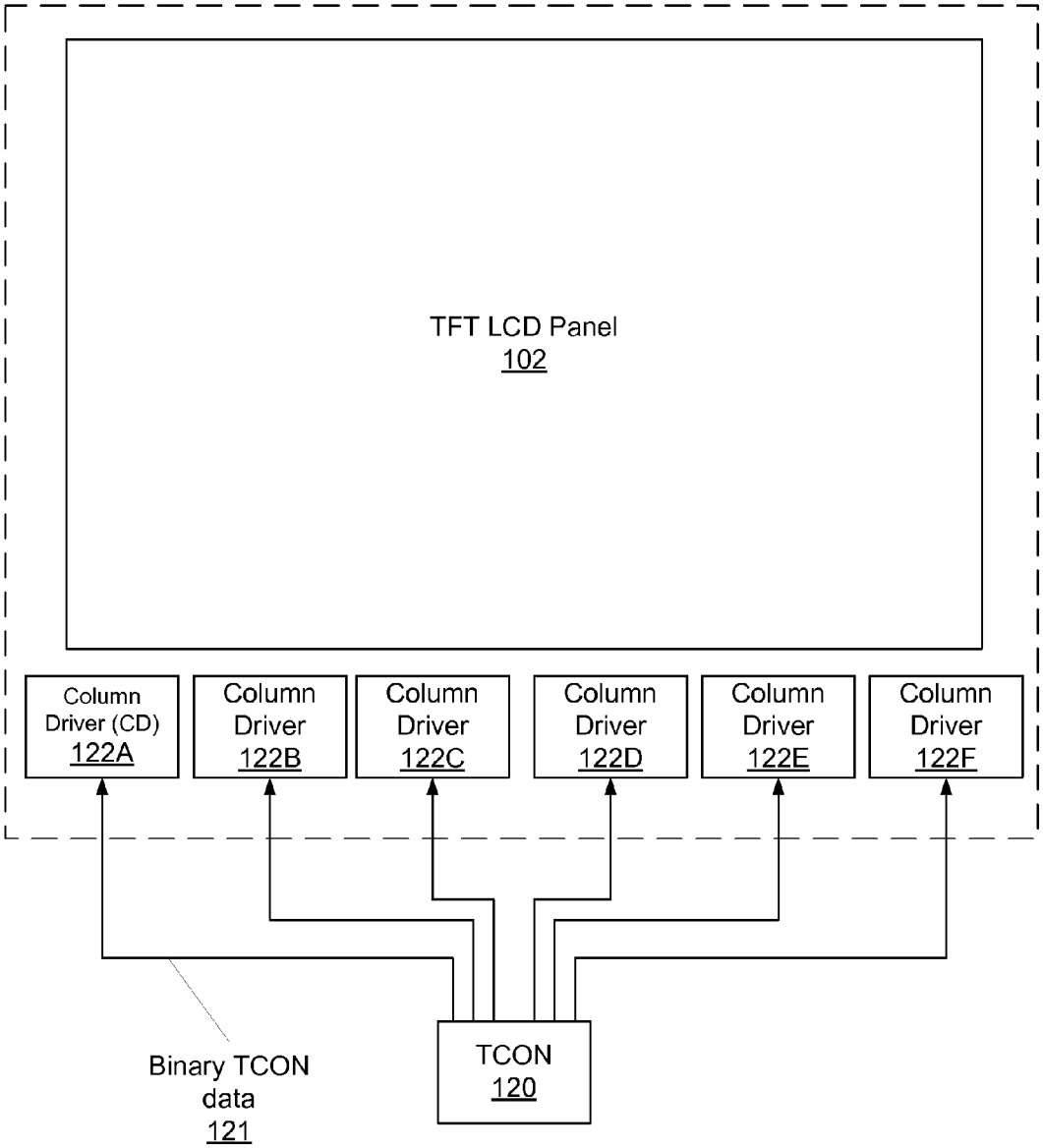
FIG. 1 illustrates a liquid crystal display (LCD) panel subsystem including a timing controller and column drivers (CDs) 122 in accordance with one embodiment.

Referring now to FIG. 1, it illustrates a liquid crystal display (LCD) panel subsystem including a timing controller 120 and one or more column drivers (CDs) 122 in accordance with one example embodiment. The TCON 120 receives an input signal from an external device such as a graphic (and/or image) processing unit (GPU) over a display interface, e.g., DISPLAYPORT. The input signal may include both main link data and auxiliary data. TCON 120 communicates with a plurality of column drivers 122A-F (generally 122) by transmitting binary TCON data 121 to the column drivers 122.

While six column drivers are illustrated in FIG. 1, any number of column drivers may be included to drive a display panel. In one embodiment, the timing controller receives the input signal and translates the RGB data and control signals into a transistor-transistor logic signal. These signals are formatted and routed to the column drivers of a display system. The signals to column drivers may contain information for a plurality of column drivers, requiring an individual column driver to identify which portion of data applies to it, or the signals may be transmitted to and contain information for only one specific column driver via a point to point intra-panel interface.

In the panel subsystem, the power consumption from the CDs 122 can be a significant portion of the power consumed by the entire panel. This is partly due to the large number of CDs that may be present in one panel depending on the panel resolution. In order to reduce column driver (CD) power consumption, the column drivers modify the received binary TCON data 121 and divide it into both a binary portion of data and Gray code data. Gray code data is encoded so that successive decimal values result in only a single bit of Gray code being changed. In certain situations, this modified data causes components of the column drivers 122 to consume less power than when working with unmodified binary TCON data 121.

Power consumption may be reduced throughout components of the column drivers including shift register and level shifters.

Figure 2:
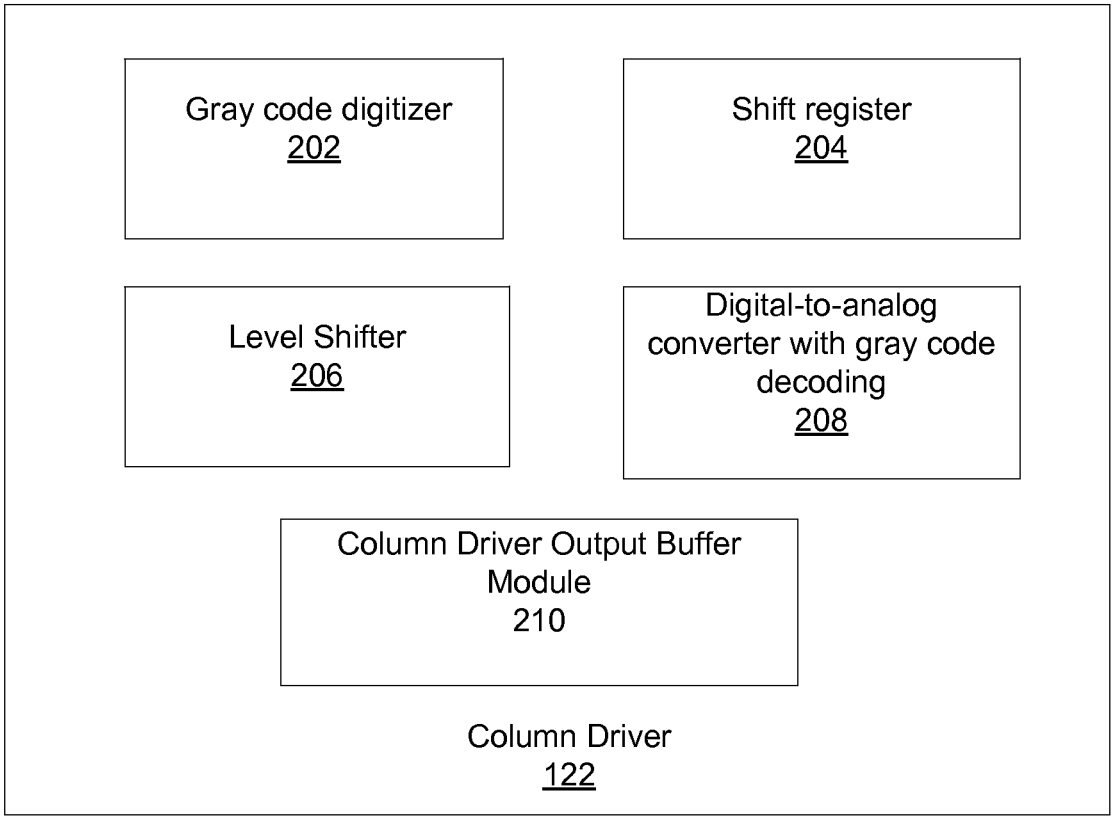
FIG. 2 illustrates a detailed view of a column driver of the display system in accordance with one example embodiment.

Turning now to FIG. 2, it illustrates a detailed view of a column driver 122 of the display system in accordance with one example embodiment. The column driver 122 includes a Gray code digitizer 202, shift register 204, level shifter 206, digital-to-analog converter 208 and column driver output buffer module 210. Communication interactions between these components are further described below.

The column driver 122 is configured to receive binary TCON data from the TCON including information instructing the column driver to properly drive a pixel, or group of pixels. The binary TCON data 121 may be individualized for each column driver in a point-to-point intra-panel interface. In another embodiment, the binary TCON data 121 may contain instructions for a plurality of column drivers 122, with each of the column drivers identifying the portion of the binary TCON data 121 that is relevant. In one embodiment, any protocol based point-to-point intra-panel interface can be utilized to control column drivers through a configuration field in a data packet. Additionally, the binary TCON data 121 may be transmitted through a packet based interface.

The Gray code digitizer 202 is configured to modify the received binary TCON data 121 and generate a portion of binary data and Gray code data. In one embodiment, the most significant bits of data are converted to Gray code, while the least significant bits of data are converted to the binary portion of data. For example, for an 8-bit binary TCON data, the data may be modified so that bits 7:3 are encoded with Gray code, and bits 2:0 remain in binary format. In one embodiment, only a portion of the binary TCON data is converted to Gray code due to the expected pattern of change in bits. For some images, there is a strong spatial correlation of neighboring pixels having similar color. Strong spatial correlation results in the more significant bits tending to have small and often successive bit changes that benefit significantly from the user of Gray code. On the other hand, the least significant bits may often change significantly reducing the positive affect of converting the least significant bits to Gray coding. Since the least significant bits are likely to non-successive values, more than one bit of the least significant bits will likely change even when converted to Gray code. In another embodiment, the least significant bits may be converted to Gray code and the most significant bits may be converted to the binary portion of data. The TCON data may be any number of bits, and the Gray code digitizer may allocate any number of bits for Gray code and the binary portion of data when modifying the received TCON data. In Gray code, two successive values differ in only one bit. Utilizing Gray code increases the randomization in the relationship between display pattern transmitted from the TCON and the coding processed by the column drivers. A table of the difference between Gray code and binary code is displayed below.

| Decimal | Gray | Binary |
|---|---|---|
| 0 | 000 | 000 |
| 1 | 001 | 001 |
| 2 | 011 | 010 |
| 3 | 010 | 011 |
| 4 | 110 | 100 |
| 5 | 111 | 101 |

As shown above, when transitioning between successive decimal values, more than one bit of binary code bits may transition. For example, when transitioning from 1 to 2, the $2^{nd}$ bit transitions from 0 to 1 and the $3^{rd}$ bit transitions from 1 to 0. Similarly, when transitioning from 3 to 4, the $1^{st}$ bit transitions from 0 to 1, the $2^{nd}$ bit transitions from 1 to 0, and the $3^{rd}$ bit transitions from 1 to 0. In contrast, in Gray code only one bit transitions values when changing between successive values. For example, when transitioning from decimal 1 to decimal 2 in Gray code, only the $2^{nd}$ bit changes value. Similarly, when transitioning from decimal 3 to decimal 4, only the $1^{st}$ bit changes value. Utilizing Gray code in column driver 122 may result in increased power on occasion and will not necessarily decrease power consumption in every iteration. However, utilizing Gray code is likely to reduce the average power consumption of column driver 122 components when processing a received pattern of binary TCON data 121.

The shift register 204 is configured to receive the binary portion of data and Gray code data and prepare them for further processing. The shift register 204 is generally a cascade of flip flops in which the output of each flip-flop is connected to the input of the next flip flop in the chain. Thus, a bit value is shifted by one position towards the output of the shift register 204 during a clock cycle. In one embodiment, the shift register receives serial input data in the form of the Gray code data and binary portion data and converts the data to parallel data for further processing. After passing through the shift register 204, the Gray code data and binary portion data is transmitted to the level shifter 206. Significant power can be saved in the shift register 204 when a bit does not transition between logical levels. Hence, utilizing Gray code data reduces the power consumption of the shift register 204 with certain input patterns.

Level shifter 206 is configured to process the Gray code data and binary portion data from the shift register 204. In one embodiment, the level shifter is utilized to shift the voltage level of the Gray code data and binary portion data bits from a logical level to a switching level that is appropriate for controlling a column driver 122.

A digital to analog converter 208 is configured to convert the digital data processed in the column driver 122 to analog data appropriate for the column driver to drive a column or row of pixels. Since the Gray code data and binary portion of data is being processed, the digital to analog converter is also configured to decode the Gray code data. After decoding the Gray code data, the digital to analog converter determines an appropriate gamma level for column driver output. In one embodiment, the gamma level is determined from the decoded Gray code data and the binary portion of data, not merely one of the pair. Finally, a column driver output buffer module 210 may be included to buffer the output of the column driver and proceed with producing the desired output to drive a column or row of pixels.

Figure 3:
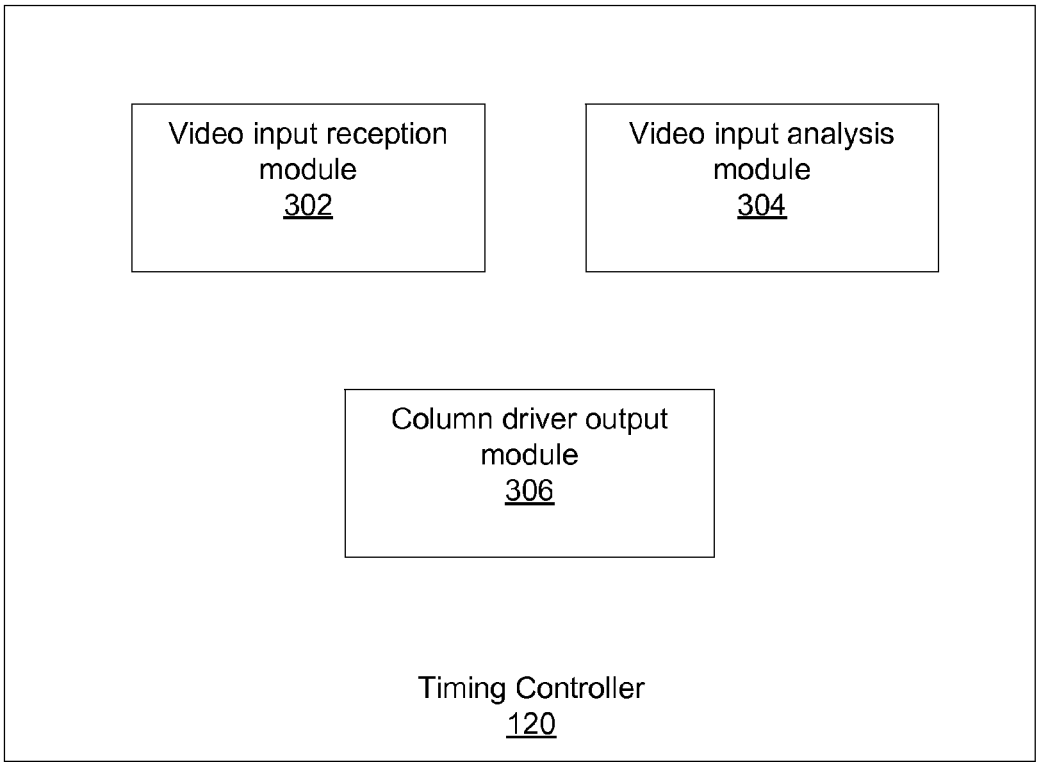
FIG. 3 illustrates a detailed view of the timing controller of the display system in accordance with one example embodiment.

Turning to FIG. 3, it illustrates a detailed view of the timing controller 120 of the display system in accordance with one example embodiment. The timing controller 120 includes a video input reception module 302, a video input analysis module 304, a column driver video output module 306. Communication interactions between these components are further described below.

The video input reception module 302 is configured to receive a video signal over a video interface, e.g., DISPLAYPORT or HDMI. The TCON 120 may accept a video signal from a variety of video interface which may include a main link and/or an auxiliary link. In one embodiment, any protocol based point-to-point intra-panel interface can be utilized to control column drivers through a configuration field in a data packet. In one embodiment, the video input signal is transmitted through a packet based interface. Additionally, the refresh rate of the video signal may be explicitly identified in the main link or auxiliary link.

The video input analysis module 304 analyzes the incoming video signal to identify actions to be taken by the TCON 120. The TCON can generate control timing information based on the input signal from a GPU or other source device. The column driver video output module 306 transmits to each CD at least the video data required for each CD to display its portion of a video frame.

Figure 4:
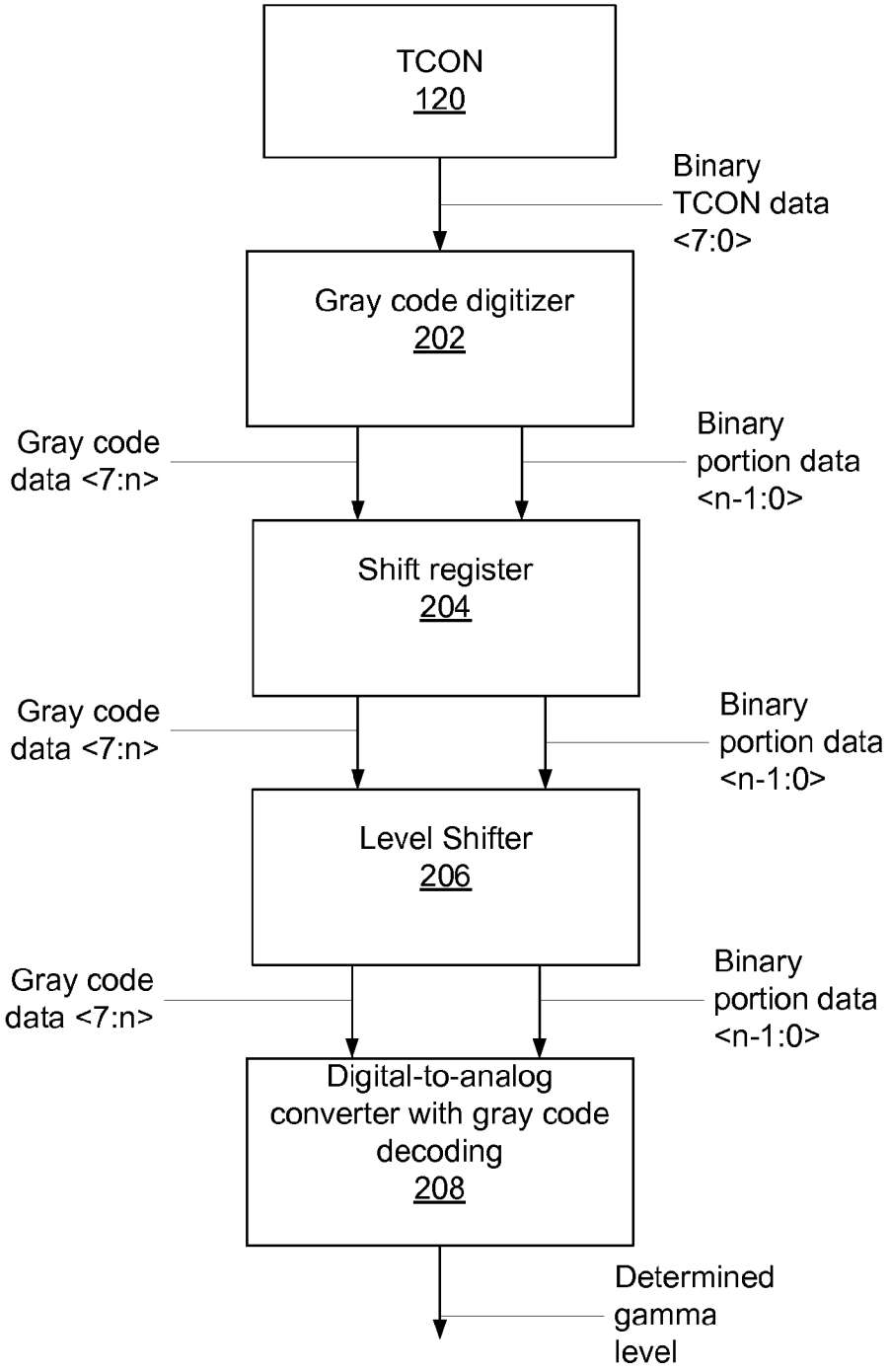
FIG. 4 illustrates an example illustration of the areas in which Gray code data is utilized in accordance with one example embodiment.

Next, FIG. 4 illustrates an example of the areas in which Gray code data is utilized in accordance with one example embodiment. The TCON 120 transmits binary TCON data 121 to the Gray code digitizer 202. In this example, the binary TCON data is 8 bits, but any number of bits may be used. The Gray code digitizer modifies the binary TCON data to produce Gray code data and binary portion of data. In the example embodiment illustrated in FIG. 4, the most significant bits, <7:n>, are encoded in Gray code, while the least significant bits, <n−1:0> are encoded in binary code. The value of n can vary from 1 to 7 in this example embodiment. The Gray code data and binary portion of data are processed by the shift register 204 and level shifter 206 as described in the detailed description of FIG. 2. In one embodiment, the shift register 204 is configured to store input data in a cascade of flip flops and shift out data to the level shifter 206. In one embodiment, the level shifter 206 is utilized to shift the voltage level of the Gray code data and binary portion data bits from a logical level to a switching level that is appropriate for controlling column driver 122. In certain situations, processing Gray code data results in reduced power consumption at the shift register 204 and level shifter 206. The digital to analog converter 208 then decodes the Gray code data and binary portion data in order to determine and output an appropriate gamma level used in column driver operation.

Figure 5:
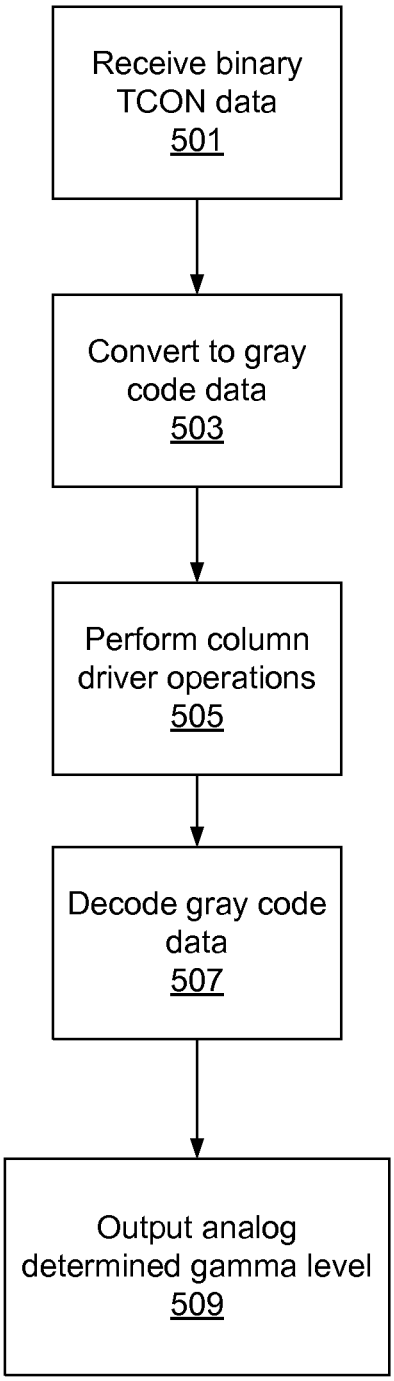
FIG. 5 illustrates a flow chart implementing the power saving technique in accordance with one example embodiment.

Referring now to FIG. 5, it illustrates a flow chart implementing the power saving technique in accordance with one example embodiment. The TCON 120 transmits and a column driver 122 receives 501 binary TCON data 121. The binary TCON data 121 is serial or parallel data containing information for the column driver to properly drive output of a row or column of pixels in a display. The column driver 122 converts 503 the binary TCON data 121 to Gray code data and a binary portion of data. Operations are performed 505 on the Gray code data and binary portion of data by the shift register 204 and level shifter 206 of the column driver.

The Gray code data and binary portion of data are then decoded 507 by the digital to analog converter 208 in order to determine information from the processed data. After decoding, the digital to analog converter 208 determines 509 the appropriate gamma level for output based on both the Gray code data and binary portion of data. The determined gamma level is used to drive a row or column of pixels in the display system.

Additional Considerations

The disclosed system and method beneficially reduce power consumption of column drivers in a display system. The column drivers in a display system process some Gray code data rather than binary data in order to reduce power consumption. Due to only one bit changing value in successive values of Gray code data, the average power consumed by column drivers is reduced for certain display patterns. Decreasing the power consumption of display systems is particularly important in portable battery powered devices, which may gain increased battery life through the utilizing of Gray code in column drivers.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules, for example, as described with FIG. 2 or FIG. 3, may constitute either software modules (e.g., code embodied on a machine-readable medium or in a transmission signal) or hardware modules. A hardware module is tangible unit capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion embodied as executable instructions or code) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The phrase "in one embodiment" in various places in the specification is not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for utilizing Gray code to reduce power consumption of a display system through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope described.

What is claimed is:

1. A method for utilizing Gray code to reduce power consumption in a display system, the method comprising:

receiving binary timing controller (TCON) data from a TCON;

encoding a set of most significant bits of the binary TCON data as Gray code data and remaining least significant bits of the binary TCON data to binary code;

performing column driver operations on the Gray code data and a remaining portion of the binary TCON data;

decoding the Gray code data and the remaining portion of the binary TCON data; and determining a gamma level for column driver output from the decoded Gray code data and the decoded remaining portion of the binary TCON data.

2. The method of claim 1, wherein utilizing Gray code results in successive decimal values differing in only one bit of Gray code.

3. The method of claim 1, wherein decoding the Gray code data and the remaining portion of the binary TCON data comprises decoding the Gray code data in order to determine a binary value.

4. The method of claim 1, wherein column driver operations include operations performed by a shift register and a level shifter.

5. The method of claim 1, wherein decoding the Gray code data and the remaining portion of the binary TCON data includes a digital to analog conversion.

6. The method of claim 5, wherein the binary TCON data is the same number of bits as the Gray code data and binary portion of data combined.

7. The method of claim 4, wherein the amount of power consumed by the shift register is based on the number of bits altered in a series of received data.

8. The method of claim 1, wherein the binary TCON data includes data prepared for and transmitted to a specific column driver.

9. A system for utilizing Gray code to reduce power consumption in a display system, the system comprising components configured to:

receive binary timing controller (TCON) data from a TCON;

encode a set of most significant bits of the binary TCON data as Gray code data and remaining least significant bits of the binary TCON data to binary code;

perform column driver operations on the Gray code data and a remaining portion of the binary TCON data;

decode the Gray code data and the remaining portion of the binary TCON data; and determine a gamma level for column driver output from the decoded Gray code data and the decoded remaining portion of the binary TCON data.

10. The system of claim 9, wherein utilizing Gray code results in successive decimal values differing in only one bit of Gray code.

11. The system of claim 9, wherein decoding the Gray code data and the remaining portion of the binary TCON data comprises decoding the Gray code data in order to determine a binary value.

12. The system of claim 9, wherein column driver operations include operations performed by a shift register and a level shifter.

13. The system of claim 9, wherein decoding the Gray code data and the remaining portion of the binary TCON data includes a digital to analog conversion.

14. The system of claim 13, wherein the binary TCON data is the same number of bits as the Gray code data and remaining portion of the binary TCON data combined.

15. The system of claim 12, wherein the amount of power consumed by the shift register is based on the number of bits altered in a series of received data.

16. The system of claim 9, wherein the binary TCON data includes data prepared for and transmitted to a specific column driver.

* * * * *